United States Patent [19]

Fitzgibbon

[11] 4,165,591

[45] Aug. 28, 1979

[54] COMPONENT TYPE BUILDING CONSTRUCTION SYSTEM

[76] Inventor: Chester M. Fitzgibbon, 837-29th Ave., S., Seattle, Wash. 98144

[21] Appl. No.: 921,057

[22] Filed: Jun. 30, 1978

[51] Int. Cl.[2] ..... E04C 1/10; E04B 2/32; E04C 2/34

[52] U.S. Cl. ..... 52/90; 52/586; 52/785

[58] Field of Search ..... 52/90, 92, 404, 586, 52/582, 587, 785, 791, 809, 810

[56] References Cited

U.S. PATENT DOCUMENTS

| | | | |
|---|---|---|---|
| 2,332,081 | 10/1943 | Hunt et al. | 52/785 X |
| 3,363,371 | 1/1968 | Villalobos | 52/90 |
| 3,466,821 | 9/1969 | O'Shaughnessy et al. | 52/785 X |
| 3,665,662 | 5/1972 | Timbrook et al. | 52/90 |
| 3,774,362 | 11/1973 | Matuschek | 52/90 |
| 3,861,095 | 1/1975 | Foxworthy | 52/90 |
| 3,898,779 | 8/1975 | Tracy | 52/90 X |
| 4,103,467 | 8/1978 | Lindal | 52/404 |

FOREIGN PATENT DOCUMENTS

| | | | |
|---|---|---|---|
| 438671 | 12/1967 | Switzerland | 52/586 |

*Primary Examiner*—J. Karl Bell

[57] ABSTRACT

Building construction system utilizing a modular or component type construction in which the components are prefabricated at a plant location and then assembled at a job or building site. The system utilizes wall, door, plumbing, over-window, under-window and filler type components together with conventional foundation structure and premade roof trusses. The components include facing members with the vertical edges of the facings being kerfed to receive a spline. The facing members are overlaid with plastic and treated with fire retardant.

7 Claims, 10 Drawing Figures

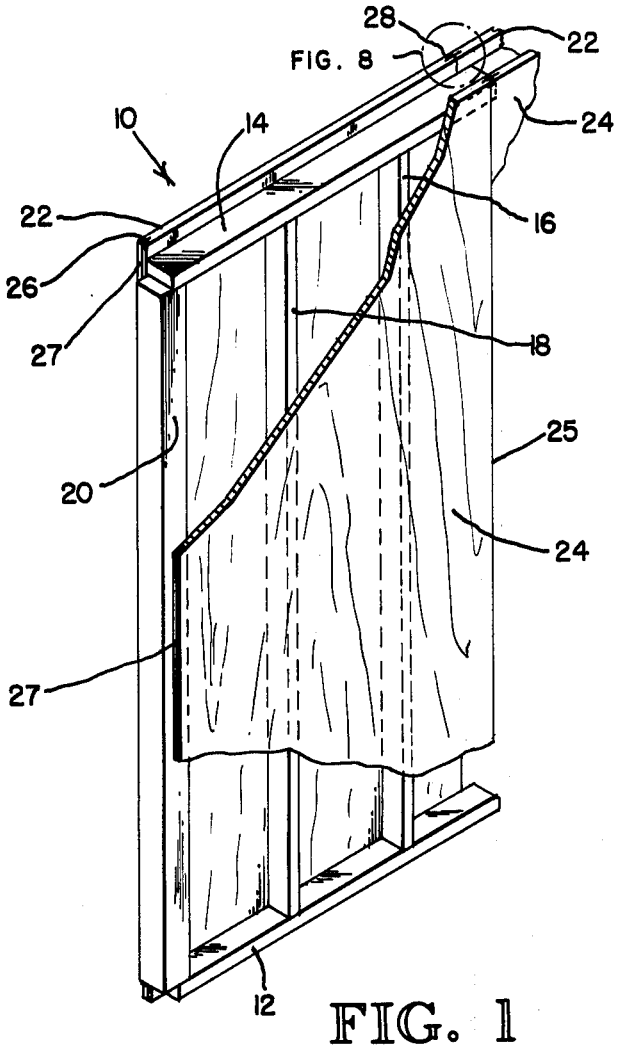
FIG. 1
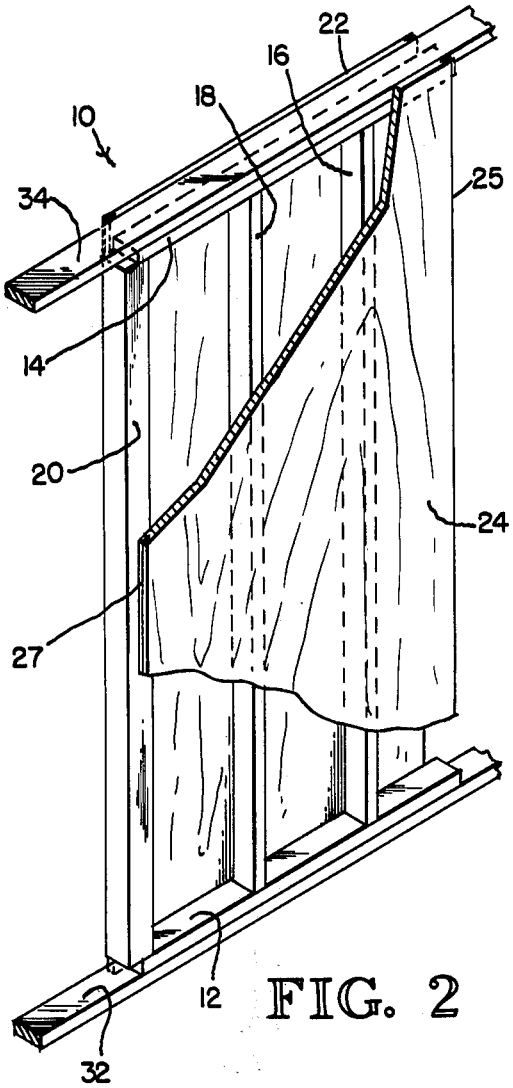
FIG. 2
FIG. 3
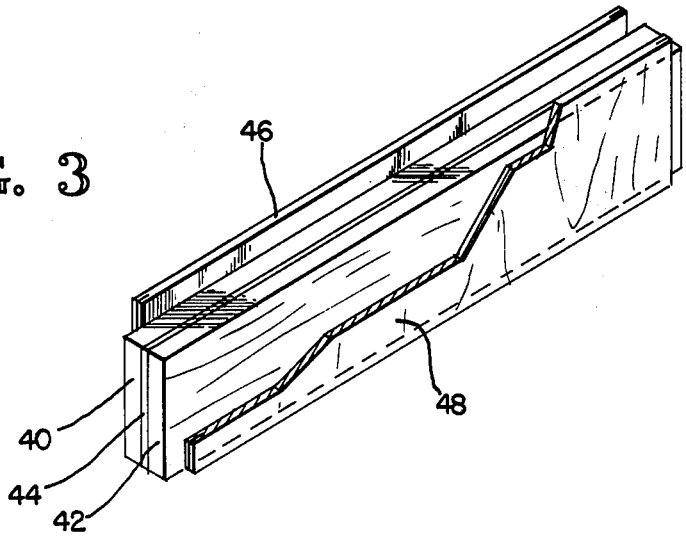

COMPONENT TYPE BUILDING CONSTRUCTION SYSTEM

BACKGROUND OF THE INVENTION

The invention relates generally to a building construction system and more particularly to a prefabricated and fire retardant system of modular component units for rapid construction of houses and buildings.

Those skilled in the art are aware of the many attempts to make prefabricated homes and buildings primarily, probably, because of the high cost of housing. For that reason, many attempts have been made to produce prefabricated or module type homes either out of plastic or of other more conventional wood frame materials. Some earlier systems tried to utilize too large sections, and it was found that prefabricated components of larger than 4×8 foot dimensions is not easily handled. In some cases, the modular sections were bare of facing on the inside and only had sheathing on the outside which, of course, required siding. Such houses were almost as expensive as conventional construction. Plastic module systems for whatever the reasons involved have neither been really accepted for residential type construction. Additionally, with conventional construction, foundations had to be laid out with absolute dimensional accuracy. Accordingly, there has been an urgent need for a low cost component or modular system utilizing more conventional materials such as 2×4 framing and plywood.

SUMMARY OF THE INVENTION

Component type building construction system in which generally conventional foundation, flooring and roof truss components are employed, but in which the interior and exterior walls are prefabricated component units. The basic component utilizes vertical studs and upper and lower plates. A fire retardant plywood having resinous overlay surfaces is used on facings of both sides of the component frame members. The facings are made to extend outwardly on one vertical edge so that the framing is recessed, while the other vertical edge has the framing extending outwardly beyond the vertical edges of the facing so as to match with the next modular component. The vertical edges of the facings of each modular component are kerfed to receive a spline for weather protection. In addition to the main components, an under-window component, an over-window header unit or component, plumbing components and, if necessary, filler components.

Accordingly, it is among the many features, objects and advantages of this invention to supply a component type building construction system particularly directed to the wall structure of a house or building. This system can be generally prefabricated and thus can be erected quickly and economically to result in a construction system which is particularly appropriate as low cost housing. The design prevents water drainage or seepage through abutting components because of splines in the vertical edges of abutting facing members. The plywood facing materials are treated with fire retardant chemicals and are further overlayed with plastic material which further reduces the fire hazard. The plastic overlay surfaces and fire retarded plywood are stronger for interior wall surfaces than sheet rock. The components can be shipped or used in any region of the world economically and the components are furnished in maximum 4×8 foot dimensions making them easily stacked and packaged for shipment. If need be, the framing members such as studs and plates and headers may be pretreated if they are to be used in jungles or termite exposed regions. The system is such as to allow for the easy installation of insulation and both wiring and plumbing may be built into the components as desired. The system does not require siding on the exterior walls nor does it need any additional finishing on the interior beyond painting. Since the system is stronger it is more durable and longer lasting and erection of the system can be easily taught to inexperienced and uneducated people. The system is adaptable to residential, commercial, farm, vacation, garage, utility storage, additions, office partitions and other types of building structures.

BRIEF DESCRIPTION OF DRAWINGS

FIGS. 1 and 2 are perspective views with sections broken away to show a basic wall component of 4×8 foot dimensions showing details of construction thereof;

FIG. 3 shows a window header component;

DESCRIPTION OF THE PREFERRED EMBODIMENT

Figure 8:
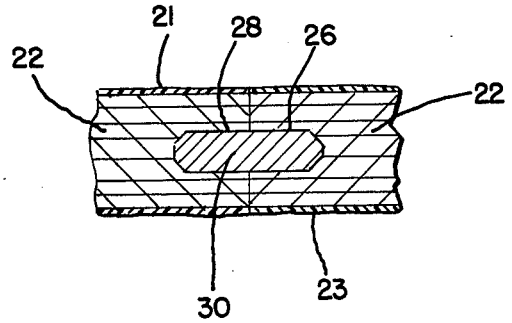
FIG. 8 shows a partial view in cross-section illustration the kerf and spline structure for abutting edges of the facing members.

FIGS. 1 and 2 show in perspective a typical 4×8 foot component unit, generally identified by the number 10, having lower plate 12 and upper plate 14. Vertical stud members 16 and 18 are spaced apart on prescribed centerline distances and as can be seen, are shown to be 2×4 frame pieces. Edge stud 20 is a 4×4 or two 2×4's with the upper and lower plate members 12 and 14 extending across half the width thereof. Facing members 22 and 24 are preferably one-half inch external grade plywood in which the veneers or laminant layers thereof are treated with a fire retardant chemical. The facings 22 and 24 in addition are overlayed by resinous paper or plastic sheets 21 and 23 of perhaps 1/32nd inch thickness as shown in FIG. 8. The facing members 22 and 24 are provided with kerfs in the vertical edges designated as elements 26 and 28, respectively. The kerfs are approximately ⅛th inch in width by approximately 3/8ths inch in depth to receive a spline member 30 as shown in FIG. 8. The splines may be made of wood, fiber, plastic or masonite as preferred. Depending on the climate into which the component system is to be shipped, the interior core or framing members, that is studs and plates, may also be chemically treated to resist termites or other deteriorating conditions which might be found in tropical or jungle climates. A hole can be bored through either the upper or lower plate 12 or 14 in order to blow insulation into the spaces between studs. If desired, the insulation could be blown into the spaces on site.

Figure 9:
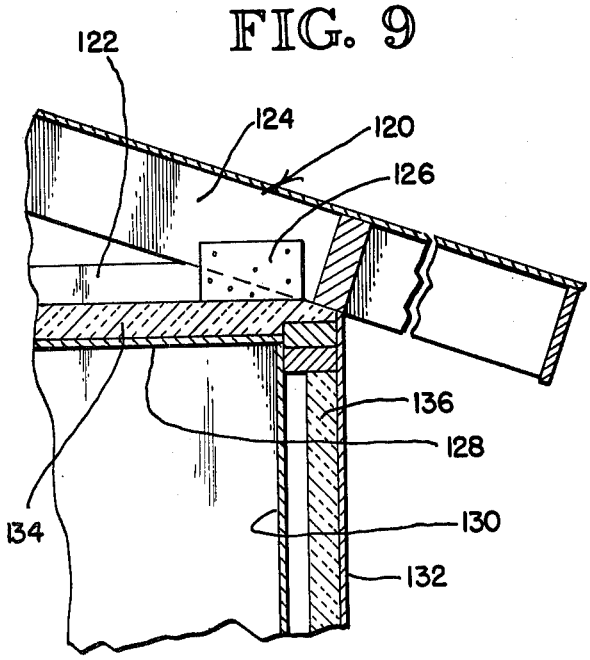
FIG. 9 shows a partial cross-section of upper exterior wall detail construction.

FIG. 2 shows that with the facing members 22 and 24, the upper edges extend above the upper and below the lower plates 12 and 14 so that when the components are put in place, the floor or sole plate 32 and roof plate 34 are received into the area of the above or below the component plates 12 and 14. It will be noted that for interior wall surfaces, the facing member may be shorter in its top to bottom dimension to allow for a ceiling facing member to be edged in over the top edge of a wall facing member as can be seen in FIG. 9. Thus it is not required that the extension of the surfacing members at the top and bottom of the components be a set distance. It will be observed however that upper and lower plates 12 and 14 of the component unit 10 extend on one edge outwardly beyond the facing edge 25 and that the other end of the upper and lower plates are flush with the edges 27 of the facings to provide mating opposed component edges. The floor and ceiling plates 32 and 34 as shown in FIG. 2 are illustrative of the component unit in place in the building structure.

FIG. 3 shows a window header component made up of core frame members or 2×10's 40 and 42 with either a space or a filler member 44 to impart the proper dimensions between facing members 46 and 48. Again, the vertical end edges of the facing members are provided with kerfs and the facing members 46 and 48 are of the composition described above with respect to facing members 22 and 24 in FIGS. 1 and 2.

Figure 4:
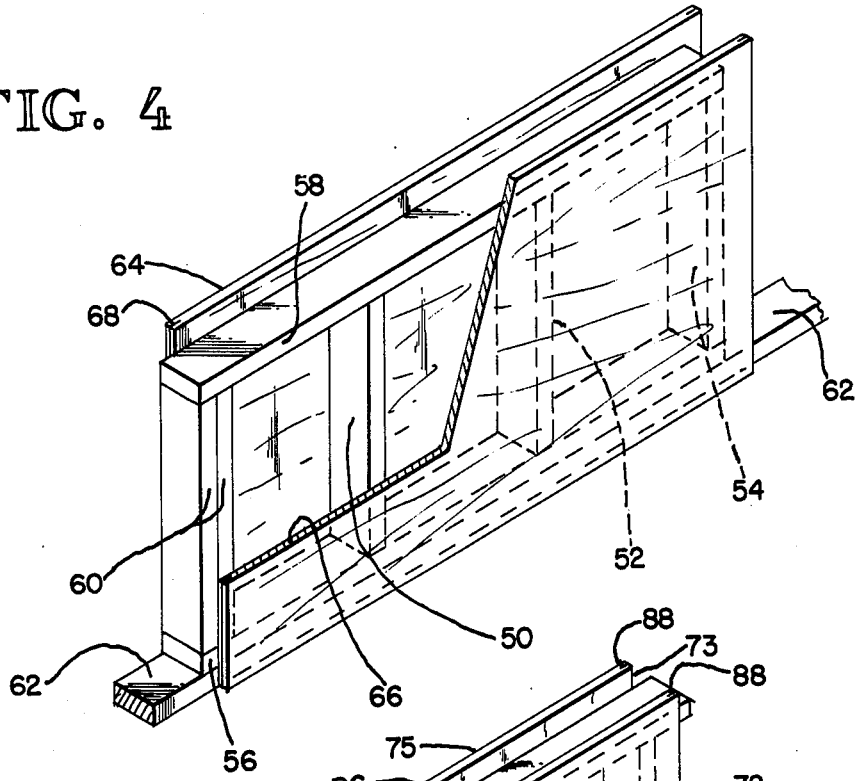
FIG. 4 shows an under-window component.

FIG. 4 is directed to an under-window component unit comprising vertical stud members 50, 52 and 54 having lower plate member 56 and upper sill member 58 together with either a double 2×4 or 4×4 protruding end stud member 60. The floor plate 62 is shown as an illustrative of the under-window unit in place. Facing members 64 and 66 are provided in the same manner as with those components above described. Again, insulation may be blown into the spaces between studs either by a hole drilled through the lower plate or through the sill member 58.

Figure 5:
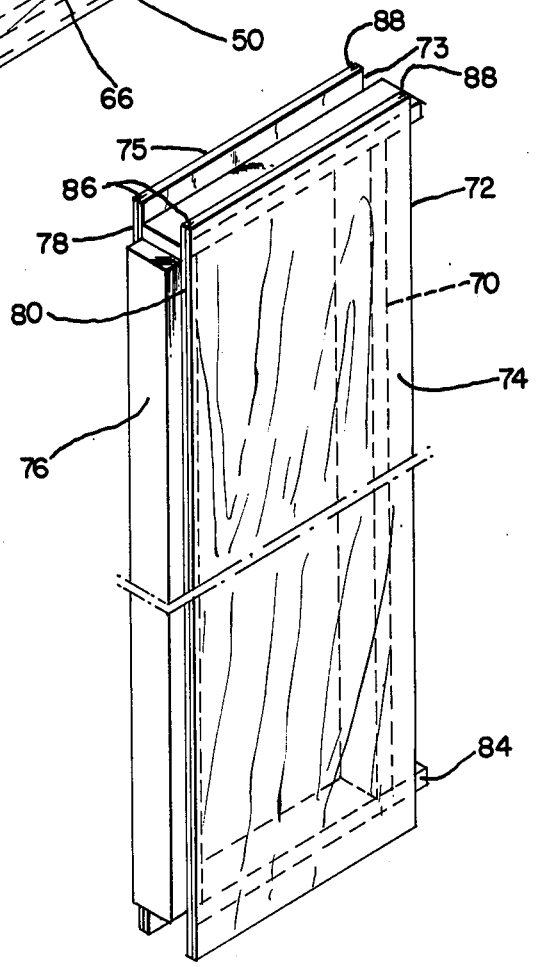
FIG. 5 shows a filler component.

FIG. 5 shows a filler member constructed in accordance with the teachings of this invention. It will be appreciated that the filler member may be of varying widths depending upon the specifications attaching to a particular building structure. It includes vertical stud 70 which as above is recessed from the edge 72 of facing member 74 and a double stud or 4×4 76 which protrudes with respect to the edges 78 and 80 of facing members 75 and 74. The filler component unit also includes upper plate 82 and lower plate 84 with the upper and lower edges of facing members 74 and 75 extending above and below the plates by desired or predetermined dimensions. Again kerf members 86 and 88 are provided in the vertical edges of the facing members as described above.

Figure 6:
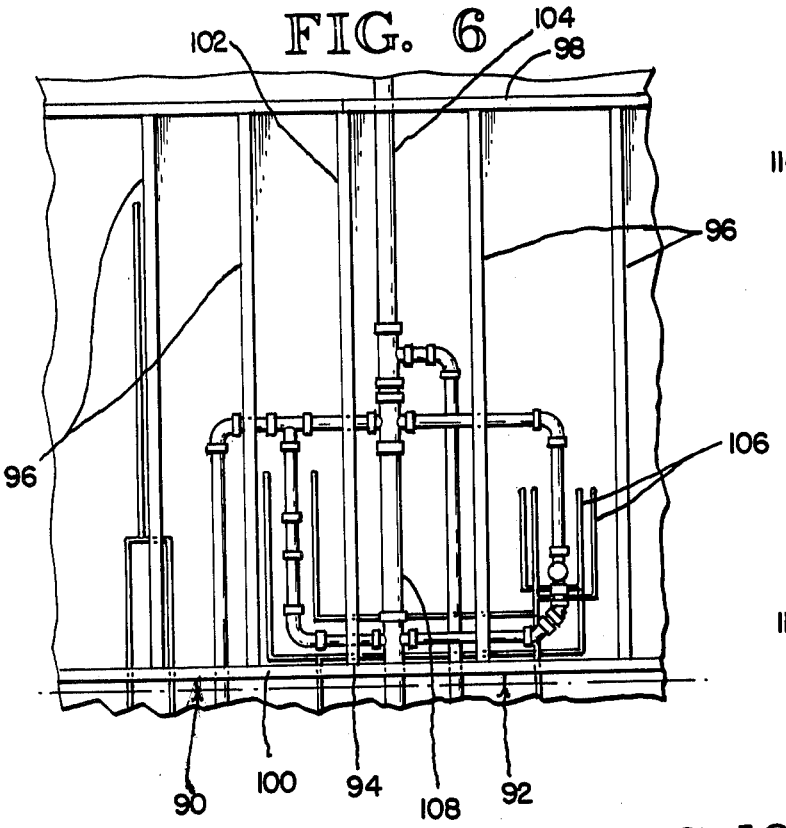
FIGS. 6 and 7 show plumbing components.

FIG. 6 shows bathroom plumbing components 90 and 92 which come together at line 94 and having studs 96 and upper and lower plates 98 and 100 respectively. The component units 90 and 92 are shipped separately to the site with the plumbing separated generally along the line of the center stud 102. The plumbing must be joined along this line but the components are shipped independently and joined on site. Conventional vent line 104, water lines 106 and soil pipe 108 and other plumbing connections are provided as part of the component structure.

Figure 7:
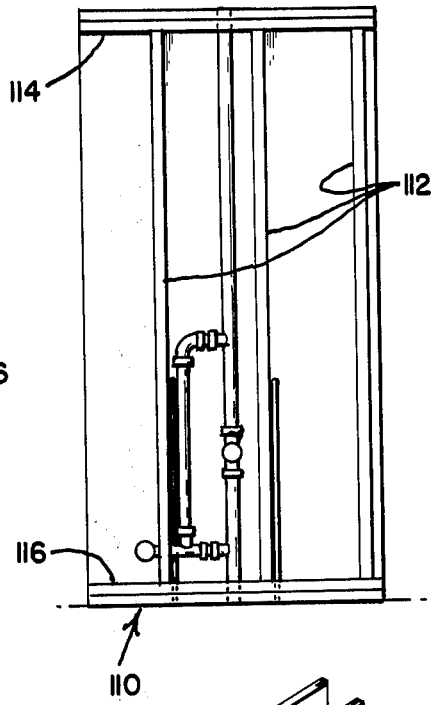

FIG. 7 shows a utility or kitchen component 110 which has studs 112, upper plate 114 and lower plate 116 with vent, drain and water plumbing lines provided for instant hookup to plumbing extending up out of the foundation and flooring. It will be appreciated that the plumbing components of FIGS. 6 and 7 are of approximately 6" thickness thus employing staggered studs to accommodate the plumbing and water lines. It will also be appreciated that in order to allow for easy access and inspection the facing members for the plumbing components are merely tacked to the surfaces of the core frame pieces and as soon as all plumbing connections are completed and inspection accomplished the facing members can be added.

FIG. 9 shows a fairly typical roof truss with joists 122 stringers 124 and metal connectors 126. The section further shows the same type of facing members 128 on the ceilings as the facing members 130 and 132 on the wall components. Insulation 134 in the ceiling and insulation 136 in the walls are provided as required.

Figure 10:
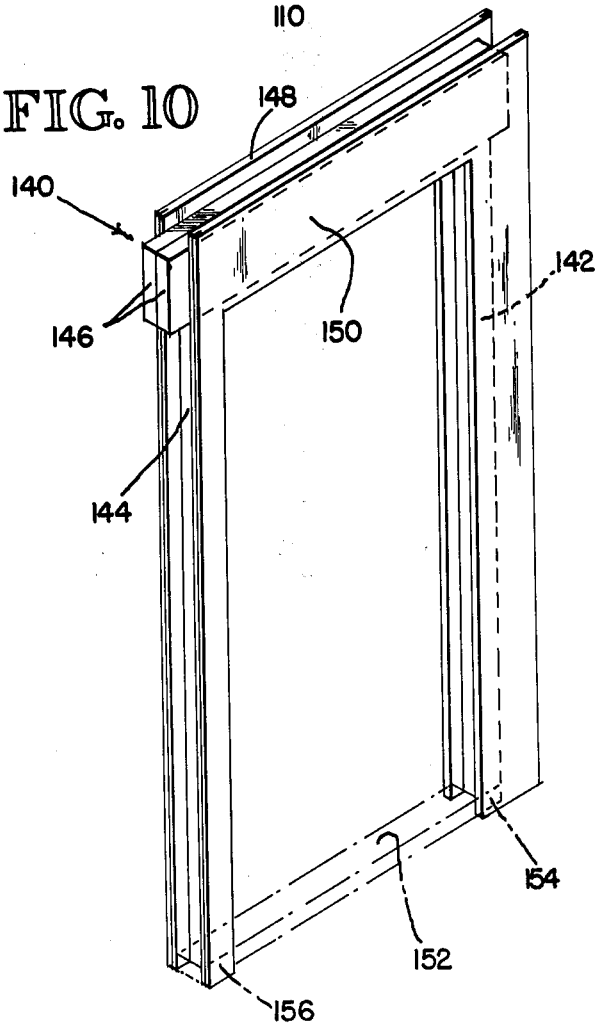
FIG. 10 shows a door component.

A door component 140 is shown in FIG. 10 and includes recessed stud 142 and in this case a stud 144 which also is recessed. Header members 146 are provided at the upper end with facing members 148 and 150 cut so that a prehung door frame and door may be installed with ease. It will be apparent that the size door opening required will shift the spacing between studs 142 and 144. A temporary connector plate 152 is provided at the bottom so that once the door component 140 is in place, the temporary plate 152 can be cut along the inside edges of the opening thus leaving partial pieces 154 and 156 under the door component unit to rest on the sole or floor plate.

It will be understood that the foundation will be a conventional concrete footing with sill plates and floor joists and subflooring so that it could also be a post and block type construction as the particular site specification may require or allow. Additionally, the ceiling surfacing component 128 as shown in FIG. 9 will be kerfed on all four edges so that again the spline 30 may be received between all abutting edges.

What is claimed is:

1. A wall components building construction system for structures having generally conventional foundation and roof construction, comprising:

(a) a core portion including structural frame members defining horizontal top and bottom edges and vertical end edges and also defining facing surfaces on each side, (b) facing members secured to said facing surfaces to form a sandwich construction in which at least one vertical edge of said core portion of said wall component is recessed with respect to one of the vertical edges of said facing members and the other vertical core edge protrudes with respect to the other vertical edges of said facing members, said facing members including spline kerf means on each vertical edge thereof for receiving a spline member, and (c) spline members for being received in said kerfs for sealing between matching abutting edges of abutting wall components.

2. The wall components building construction system according to claim 1 and in which said facing members are fire retarded plywood members with exterior plastic overlay surfaces and in which the upper and lower horizontal edges thereof extend above and below the top and bottom core edges respectively by a predetermined distance.

3. The wall components building construction system according to claim 2 and in which said core portion has spaced apart vertical stud members and upper and lower plate members, and in which that vertical core edge which protrudes is generally double the thickness of other vertical stud members.

4. The wall components building construction system according to claim 2 in which said component is an under-window component unit.

5. The wall components building construction system according to claim 2 and which is a door component unit with said facing members and frame members being formed to accept a door structure.

6. The wall components building construction system according to claim 2 and which contains preinstalled plumbing and in which the core portion is thicker than other wall components.

7. The wall component building construction system according to claim 2 and which is a filler unit of variable width.

* * * * *